US005903971A

United States Patent [19]

Ishiwata et al.

[11] Patent Number: 5,903,971

[45] Date of Patent: May 18, 1999

[54] WIRE TERMINATION APPARATUS FOR MAKING WIRE HARNESSES

[75] Inventors: Yoshio Ishiwata, Isehara; Yoshikatsu Toyofuku, Kurume; Takeshi Yukitake, Krume, all of Japan

[73] Assignee: Molex Incorporated, Lisle, Ill.

[21] Appl. No.: 08/965,707

[22] Filed: Nov. 7, 1997

[30] Foreign Application Priority Data

Nov. 22, 1996 [JP] Japan ..... 8-327775

[51] Int. Cl.[6] ..... H01R 43/01; H01R 43/28

[52] U.S. Cl. ..... 29/748; 29/33 M; 29/721; 29/755; 29/866

[58] Field of Search ..... 29/33 M, 720, 29/721, 747, 748, 749, 754, 755, 760, 866

[56] References Cited

U.S. PATENT DOCUMENTS

| | | | |
|---|---|---|---|
| 4,014,087 | 3/1977 | Cover et al. | 29/721 |
| 4,907,324 | 3/1990 | Shah et al. | 29/33 M |
| 4,912,823 | 4/1990 | Shah et al. | 29/748 X |
| 5,138,762 | 8/1992 | LeBan et al. | 29/749 |
| 5,590,457 | 1/1997 | Ninchi | 29/721 |
| 5,709,025 | 1/1998 | Wuyts | 29/721 X |
| 5,709,027 | 1/1998 | Kato et al. | 29/749 X |
| 5,761,796 | 6/1998 | Imgrüt et al. | 29/748 |
| 5,791,037 | 8/1998 | Takada et al. | 29/748 X |

FOREIGN PATENT DOCUMENTS

| | | | |
|---|---|---|---|
| 66060 | 12/1982 | European Pat. Off. | 29/721 |
| 5047448 | 6/1993 | Japan | 29/721 |
| 1446535 | 8/1976 | United Kingdom | 29/721 |

*Primary Examiner*—Peter Vo
*Attorney, Agent, or Firm*—Charles S. Cohen

[57] ABSTRACT

Disclosed is an improved termination apparatus for use in making wire harnesses. The apparatus includes: a connector holder for holding connectors in line; a connector holder drive; a punch for termination a selected terminal of a connector onto a selected wire; a wire insertion-and-guide station for inserting and guiding a wire to the termination position, a detector means for detecting arrival of the inserted wire at the termination position and a test pin for establishing a circuit with the inserted wire; and, a control circuit for controlling the connector holder drive. Under operation of the control circuit, a connector in the connector holder is first aligned with the termination punch. Second, in response to an action taken by an associated identifying means located between the test pin and the free end of a selected wire among the electric wires whose one ends are connected to another connector, a selected connector in the connector holder is positioned such that its selected terminal is also in alignment with the termination punch; and third, selected terminals are presented one after another in alignment with the termination punch.

11 Claims, 9 Drawing Sheets

WIRE TERMINATION APPARATUS FOR MAKING WIRE HARNESSES

BACKGROUND OF THE INVENTION

The present invention relates to a wire termination apparatus for use in making wire harnesses wherein each harness includes one or more insulation displacement terminal ("IDT") style connectors and a plurality of wires, one or both opposing ends of which are connected to the connectors.

Two general methods of making harnesses are known. One such method consists of sequentially terminating the terminals of an electric connector to wires, known as the "separate termination method." The other method consists of simultaneously terminating the terminals of a connector onto the wires as a whole, known as the "whole termination method." Usually the wire terminating apparatus utilized in the separate terminating method includes a reciprocating connector holder for arranging and holding a series of connectors in a row and a terminating apparatus for terminating a selected terminal of the connector to a corresponding wire intended for connection to the connector. The terminating apparatus is positioned above a reciprocating connector holder and reciprocates vertically with respect to the connector.

In operation, one terminal of a selected connector is brought to the termination position, and an operator has to insert a selected wire into the apparatus and hold the wire in position until the termination operation has been completed. This process must be done carefully when a desired order of wire termination is required.

After completing the connecting of one set of free ends of the wires to the terminals of the connector, the remaining set of free ends of the wires are usually connected to the terminals of another connector. In this case, an exact terminal-to-terminal registration is required between the two connectors connected by the wires. It is, however, difficult to connect to the wires selected to a correct terminal selected of the other electric connector. Repeated manual, visual selection and termination of the wires is tedious and often is prone to error.

The present invention is directed to an improved wire termination apparatus that has a means for selectively identifying particular harness wires and their terminal destinations and that substantially reduces operator error.

SUMMARY OF THE INVENTION

One object of the present invention is to provide a wire termination apparatus for use in making harnesses according to the separate termination method that permits one or more connectors to be connected to one or both ends of plurality of wires by terminating without any fear of making wrong connections.

To attain this object, a wire terminating apparatus according to the present invention is provided with a structure that determines which terminal of a selected connector should be connected to a selected wire inserted and held in a guide station of the apparatus, while moving the connector into the termination position, where the determined terminal is registered with a wire terminating punch. Thus, the required registration is effected in terms of a single wire every time it is inserted in the guide station of the apparatus.

Specifically, a wire termination apparatus for use in making harnesses in accordance with the principal aspects of the present invention includes a connector holder for arranging and holding one or more connectors in a longitudinal line, the holder being slidable in a reciprocating workpath; a holder drive using a stepping motor for driving the holder and an associated rotary encoder for determining the location of the designated terminal with respect to the selected connector; a termination punch for terminating the designated terminal to a selected wire in the connector, the terminating punch being positioned above the workpath in which the holder reciprocates, and vertically reciprocatable with respect to the workpath; a wire guide station for inserting and guiding a selected wire to the termination position, and means for detecting the end of the inserted wire when arriving at the termination position and a conductive test pin for establishing an electrical connection with the inserted wire, and a control circuit for controlling the aforementioned elements.

The control circuit permits the connectors of the holder to be put sequentially in alignment with the descending termination punch in response to the identifying action by an associated wire-terminal identifying means located between the test pin and the free ends of the electric wires connected to a first connector. The control circuit determines which terminal of a second connector must be put in alignment with the termination punch, or it permits a selected terminal of a connector to be put in alignment with the termination punch. With this arrangement, a plurality of wires can be connected easily to the terminals sequentially at an increased efficiency. Also advantageously, in case that a plurality of wires are connected at one set of free ends thereof to a connector beforehand, the free ends of the wires can be connected efficiently to corresponding terminals of one or more additional connectors to form a required harness without causing any wrong connections.

The wire insertion-and-guide station may be equipped with a pair of spring-biased clamps that effect a positive clamping of a selected wire in the insertion-and-guide station in order to assure that the wire is put in correct alignment with the corresponding terminal selected among those of the connector. Regardless of the wire size of the selected wire, the wire is positively held without the necessity of adjusting the space between the opposing insertion guide pieces. The conductive test pin is moveable to be brought towards and away from the end of the inserted wire.

The holder drive may have a movable table, and the holder may be detachably mounted to the movable table. Thus, holders that each accommodate connectors of a different size can be selectively mounted to the movable table. The movable table may have means for determining which type of holder is mounted thereon as well as the type of connectors held therein, such as connectors having terminals arranged on one side or having terminals arranged on both sides.

In one particularly useful aspect of the present invention, the wire-terminal identifying means includes a mating connector element mounted to the apparatus to which a first connector element (after having a set of wire ends terminated thereto) is attached, the mating connector element being operatively interconnected to the wire-terminal identifying means so that the conductive test pin completes a circuit with the selected wire held by the wire guide station in order to determine the correct matching terminal for a subsequent connector that is to be affixed to the harness wires.

These and other objects, features and advantages of the present invention will be clearly understood through a consideration of the following detailed description.

BRIEF DESCRIPTION OF THE DRAWINGS

In the course of the following description of the detailed description, reference will be made to the attached drawings wherein like reference numerals identify like parts and wherein.

DESCRIPTION OF PREFERRED EMBODIMENTS

Figure 1:
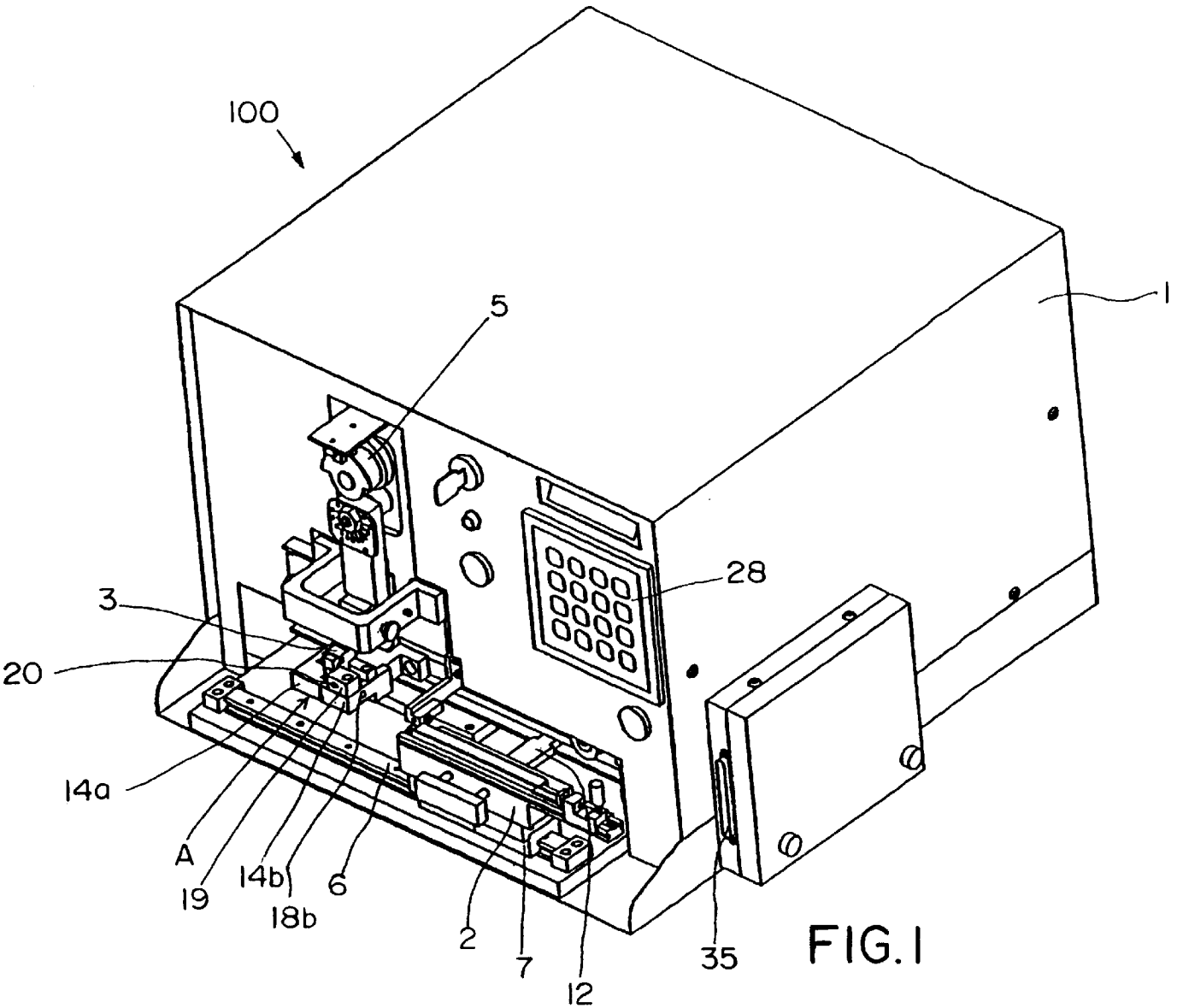
FIG. 1 is a perspective view of one embodiment of a wire termination apparatus constructed in accordance with the principles of the present invention.
Figure 2:
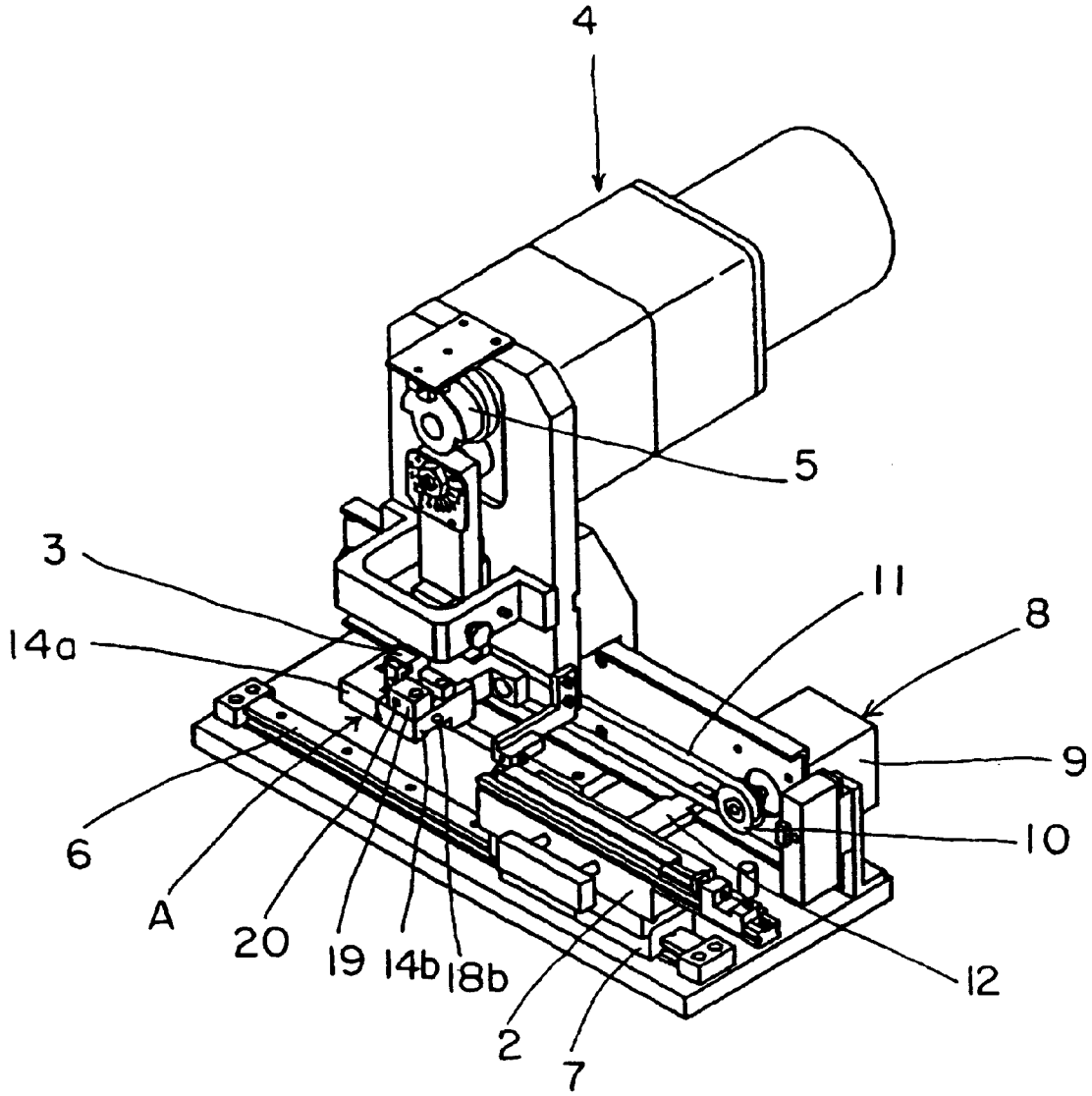
FIG. 2 is a perspective view of the main internal components of the wire termination apparatus of FIG. 1.

FIG. 1 illustrates one embodiment of a wire termination apparatus 100 for making wire harnesses constructed in accordance with the principles of the present invention. FIG. 2 illustrates the major operational components of the wire termination apparatus with the exterior housing 1 removed for clarity. The connectors used in the apparatus 100 are preferably of the insulation displacement terminal type that are well known in the art. These connectors typically have a insulative connector body portion and a plurality of conductive terminals arranged on one, or both, sides of the connector body. In order to effect termination of a wire to an IDT connector, loose wires typically are pressed into contact with the terminals such that the terminals cut into, or displace, a portion of the wire insulation to contact the inner conductors of the wires.

The apparatus includes a connector holder 2 that arranges and holds one or more connectors in a longitudinal line or connector workpath that extends between opposing ends of the apparatus. This holder 2 is located in the lower area at the front of the housing 1. The connector holder 2 reciprocates along the connector workpath.

A termination punch 3 is provided in the apparatus 100 for terminating a selected terminal of a connector held by the connector holder 2 onto a selected wire. The punch 3 reciprocates vertically so that the punch 3 may be raised above and lowered into the reciprocating workpath of the connector holder 2. A punch drive 4 is provided in order to drive the punch 3 and it includes an electric motor, a clutch, speed reduction gears and other gears in order to operate the punch 3. In order to raise and lower the punch 3, an eccentric cam 5 is provided and rotates approximately one revolution for each termination action. A connector holder drive 8 has a moveable table or support 7 that runs on a rail 6, which is located in the lower area of the front of the housing 1. The connector holder drive 8 comprises a stepping motor 9 and an associated rotary encoder. The rotary encoder is operatively linked with the motor 9 and is used for determining the location of the designated terminal with respect to a connector positioned within the connector holder 2. The stepping motor 9 has a pulley 10 on its shaft, and the pulley 10 is connected to the movable table 7 via associated belt 11 and joint piece 12.

Figure 3:
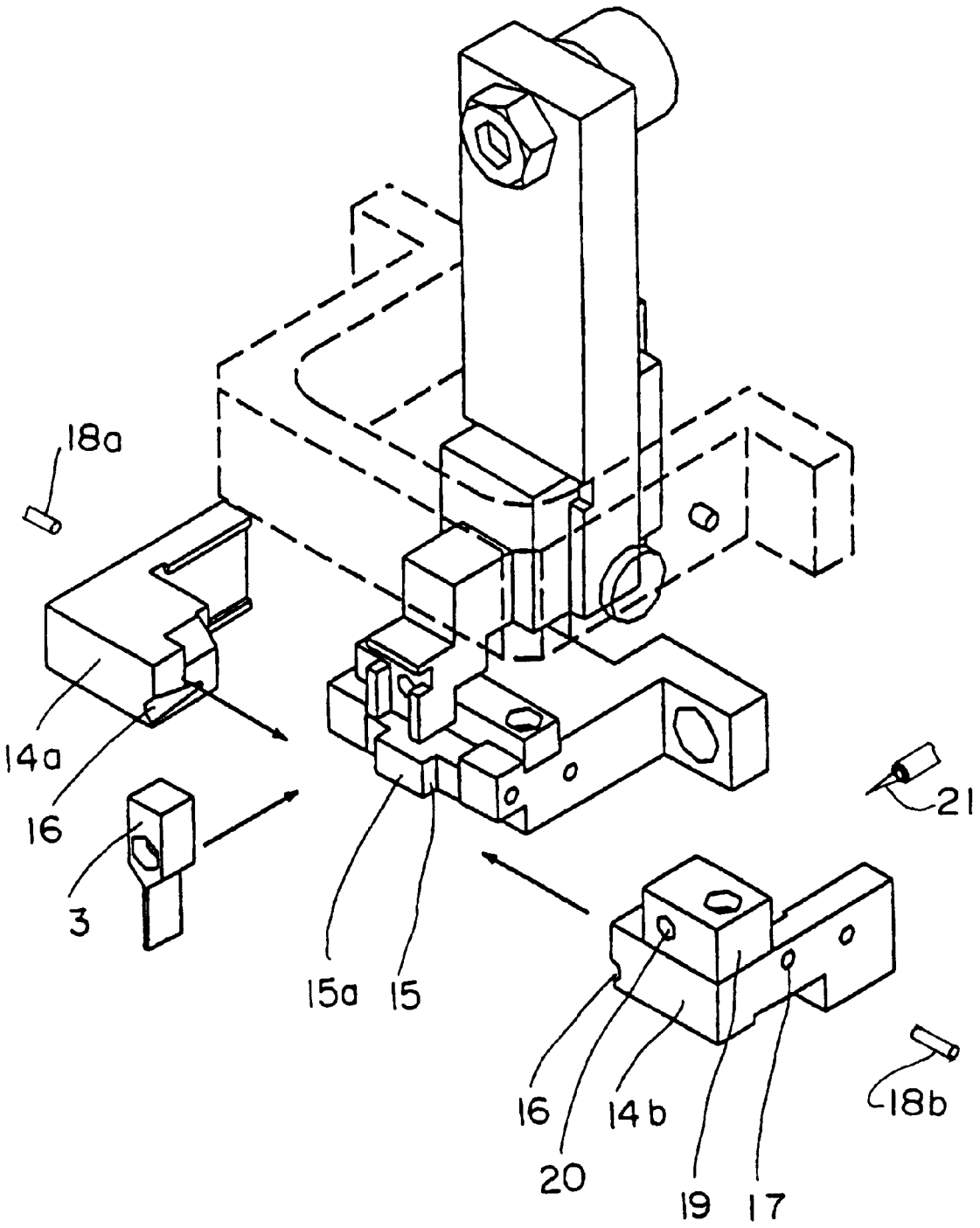
FIG. 3 is an exploded view of the wire insertion-and-guide station of the wire termination apparatus of FIG. 1.

A wire guide station A is provided for inserting and guiding a wire to the punching position. This guide station A is disposed below the punch 3 and above the connector holder 2 and connectors held therein. As best seen in FIG. 3, the station A includes left and right guide pieces 14*a* and 14*b* disposed in front of a stop block 15. These guide pieces 14*a*, 14*b* are separated by a distance somewhat less than the diameter of the electric wire. Each guide piece 14*a*, 14*b* has a guide recess 16 formed therein and extending to its front which permits a wire to be inserted therein. The two guide recesses 16 cooperatively form a wire guide passage when the guide pieces 14*a*, 14*b* come together, and a wire inserted therein will impinge upon the stop block 15.

Each guide piece 14*a*, 14*b* has a sensor hole 17 extending therethrough that is aligned with the front 15*a* of the stop block 15. An optical sensor is provided that includes a light-emitter 18*a* and a light-receiver 18*b* that are aligned with each other so that a beam of light travels through the holes 17 of the opposing guide pieces 14*a*, 14*b*, to form a means B (FIG. 6) for detecting the end of a wire inserted into the guides 14*a*, 14*b* and impinging on the front 15*a* of the stop block 15.

Returning to FIG. 3, the right guide piece 14*b* has a block 19 disposed thereon with a wire guide hole 20 extending therethrough from front to rear which permits the insertion of a wire therein. A conductive test pin 21 is positioned near the rear of the block 19 and is aligned with the hole 20 for establishing an electrical connection between the test pin 21 and wire inserted into the guide hole 20 in order to properly locate the selected wire inserted therein with respect to its position in a connector as explained in greater detail below.

Figure 4:
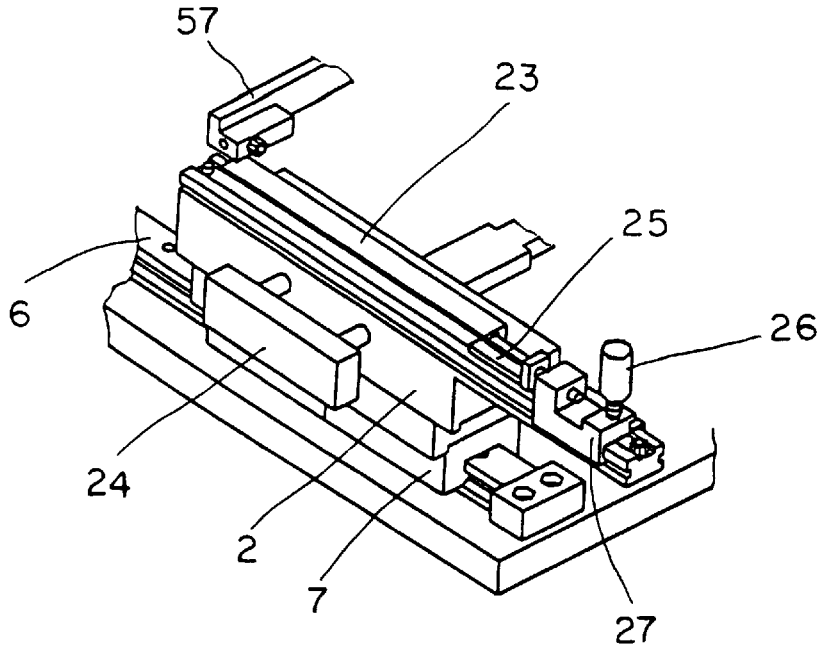
FIG. 4 is a perspective view of the connector holder of the wire termination apparatus of FIG. 1.
Figure 5:
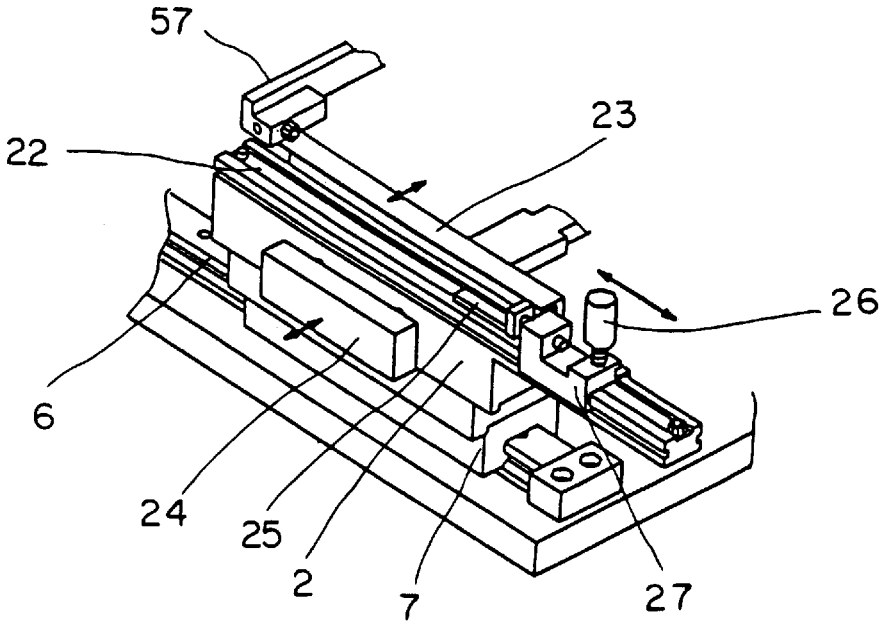
FIG. 5 is the same view of the connector holder of FIG. 4, showing the connector alignment mechanism in a withdrawn position.

Referring now to FIGS. 4 and 5, a plurality of connectors are shown in the slot 22 of the connector holder 2 arranged longitudinally in serial order, so that the head of the following connector abuts the tail of the preceding connector. An L-shaped connector aligner 23 is movably attached to one side of the connector holder 2, and the aligner 23 has a lever 24 connected thereto. The aligner 23 is urged forward by means of a spring (not shown) disposed between the lever 24 and the connector holder housing. The aligner 23 may be pushed rearwardly by pushing the lever 24 against the connector holder 2. In a normal position the aligner 23 overhangs the connectors aligned in the longitudinal slot 22. A connector stopper 25 is spring-connected to an associated U-shaped block 27 that fixes the connector stopper 25 at a desired longitudinal position (to the right of FIG. 5) by using an associated set screw 26 or other fixing member.

Figure 6:
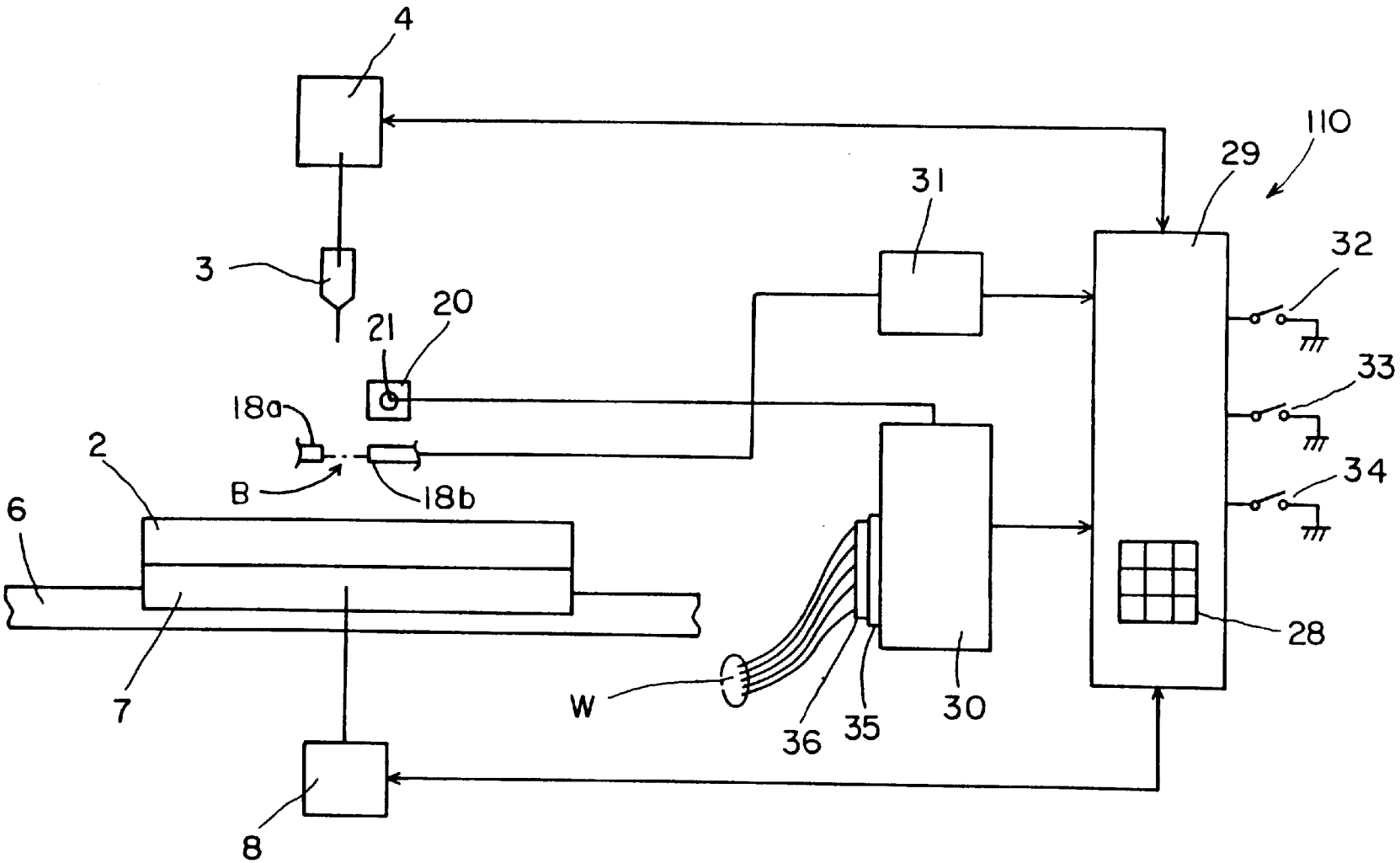
FIG. 6 is a block diagram of the control system and particularly a control circuit used in the termination apparatus of FIG. 1.

FIG. 6 illustrates a control system 110 used for the wire termination apparatus that permits operation in three different modes: a sequential termination mode; a conduction-and-termination mode; and, a selective termination mode. In the sequential termination mode, the connectors are subjected one after another to the termination operation, beginning with the first connector (the leftmost one in the longitudinal line) in the slot 22.

In the conduction-and-termination mode, one terminal is selectively identified among the connectors in terms of a particular wire that is to be connected to selected terminals of each connector. This identification is made with the aid of the conductive test pin 21. The apparatus 100 then brings the so-identified terminal of the connector to the termination position, where the selected wire is terminated to the terminal. In this mode, a plurality of harness wires are typically connected to an end connector, and the remaining free ends of the wires need to be connected to at least one other connector to form a harness.

In the selective termination mode, the connector terminals are selected by sequentially depressing keys selected among an array of keys 28, and the selected terminals are brought, one after another, to the termination position of the apparatus 100. In order to attain the functions of these different modes, the control system 110 is interconnected to the punch drive 4 of the termination punch 3 and the table drive 8 of the table 7 of the wire termination apparatus.

The control system 110 includes a control circuit 29, a terminal identifying unit 30 and wire-insertion detecting unit 31. The control circuit 29 is capable of receiving and transmitting signals to the punch drive 4 and the table drive 8 of the termination apparatus, and also of receiving signals from the terminal identifying unit 30 to which the conductive pin 21 is connected. It also receives and transmits signals from the wire-insertion detecting unit 31 to which the optical sensor components of the light-emitter 18*a* and light-accepter 18*b* are connected. The control circuit 29 further preferably has individual switches 32, 33 and 34 for respectively selecting the sequential termination mode, conduction-and-termination mode and selective termination mode. The terminal identifying unit 30 has an electric connector 35 fixed to one side of the housing 1 (FIG. 1) for mating with an electric connector 36 having a plurality of electric wires connected thereto beforehand.

Now, the mode of operation and the wire termination apparatus shall be described. First, a plurality of connectors are placed in the longitudinal slot 22 of the connector holder 2. The connector aligner 23 is pushed apart from the connector holder housing by pushing the lever 24 inwardly and the slot 22 is then loaded with connectors. (FIGS. 4 and 5). After loading the slot 22 with connectors, the connector aligner 23 returns to its original position overhanging the line of connectors. The number of terminals in each connector, the terminal-free space between the tail terminal of the preceding electric connector and the head terminal of the following electric connector and other physical connector and harness data are stored in the control circuit 29 in an appropriate memory chip, such as standard ROM ("read-only memory"), prior to operation of the apparatus.

When the switch 32 is turned "on" for operation of the termination apparatus in the sequential termination mode, a command signal (in the form of pulse) is transmitted to the table drive unit 8 (particularly to the stepping motor 9) to move the support table 7. This movement brings the first terminal of a first electric connector into a termination position in which the terminal faces the punch 3 raised above it. Then, a terminal-location signal (i.e., another pulse signal from the rotary encoder) is transmitted from the table drive unit 8 to the control circuit 29.

One wire is then selected from the plurality of wires used to make the harness and is inserted in the wire guide station A. When the inserted wire impinges on the front surface 15*a* of the stop block 15, the light beam travelling between the light-emitter 18*a* and light-accepter 18*b* is interrupted by the end of the wire. This interruption produces and transmits an insertion-finish signal from the insertion detector means 31 to the control circuit 29. The inserted wire is thereupon pinched and held between the two wire guide pieces 14*a*, 14*b* in the wire guide station A. The control circuit 29 responds to the terminal-location signal and the insertion-finish signal and then transmits a drive signal to the driver 4 of the punch 3, thereby beginning one cycle of a single descent of the termination punch 3 to terminate the end of the inserted wire onto the first terminal of the electric connector.

A termination-finish signal is then transmitted from the punch driver 4 to the control circuit 29. This signal indicates to the control circuit 29 that the termination of the first terminal of the connector is completed. Upon receipt of this signal, the control circuit 29 transmits another signal to the table drive unit 8 and initiates a second movement of the support table to bring a second terminal of the connector to the termination position for termination thereof to another selected wire. The same proceedings are repeated to effect sequential termination to the terminals of each of sequential wire.

Upon turning switch 33 "on," the termination apparatus operates in the conduction-and-termination mode in which a first wire is selected from a plurality of harness wires whose opposite ends have been previously connected to a connector. The selected wire is contacted by the conductive test pin 21 to determine which terminal of a connector in the connector holder 2 is to be terminated to the selected wire. Finally, the selected wire is transported to a termination position relative to the corresponding terminal selected of the connector.

Specifically, an end connector 36 to which a set of harness wire free ends has been previously connected is mated with an adapter connector 35 of the wire-terminal identifying unit 30. A first wire is selected from the set of harness wires, and the free end of the selected wire is inserted into the guide hole 20 of the block 19, until electrical contact is made between the selected wire free end and the conductive test pin 21. This contact makes a closed circuit with the wire-terminal identifying unit 30 via the connection between the adapter connector 35 and the end connector 36, and thus determines and informs the control circuit 29 which terminal of the connector held in the connector holder 2 establishes a proper closed circuit with the inserted wire.

The control circuit 29 subsequently transmits a command signal to the table drive 8 to bring the selected connector terminal to the termination position, and the table drive 8 transmits a terminal-location signal to the control circuit 29. The selected wire is then inserted in the wire guide station A until its free end impinges on the front surface 15*a* of the stopper block 15. Then, the wire detector means B sends an insertion-finish signal to the control circuit 29. The control circuit 29 responds to the terminal-location signal and insertion-finish signal and transmits a drive signal to the punch driver 4. The punch 3 makes a single descent and forces the end of the wire into the selected terminal of the connector. A termination-finish signal is transmitted to the control circuit 29, so that the control circuit 29 waits for insertion of a subsequent selected wire into the guide hole 20 of the block 19. The same proceedings are repeated to effect sequential terminations on the remaining wires in serial order.

Upon turning switch 34 "on," the termination apparatus operates in the selective termination mode. The keys 28 are selectively pressed to select a single, particular terminal among those of the connector. This selection is made in terms of the number of terminals of each connector. The control circuit 29 responds to this input that identifies to which terminal a wire is to be terminated and thereupon transmits a command signal to operate the table drive unit 8 and moves its support table 7, thereby bringing the selected terminal of the connector into the termination position underneath the punch 3. This selected terminal corresponds to the number previously entered into the key pad 28. A terminal-location signal is transmitted from the table drive unit 8 to the control circuit 29. Similarly, a wire is inserted in the wire insertion-and-guide station A. The inserted wire impinges the front surface 15*a* of the stop block 15 to trigger the detector means B to transmit an insertion-finish signal to the control circuit 29.

The control circuit 29 then transmits a drive signal to the punch driver 4, which causes a single descent of the punch 3 to terminate the selected terminal of the connector to the end of the inserted wire. Selective terminal-to-wire termination can be repeated as many times as required by selecting a specific terminal of the connector in terms of the numbers allotted thereto with the aid of the terminal-identification keys 28. For example, the control circuit 29 may be programmed to accept ten wires and keys one through ten on the key pad 28 may then represent the ten wires, respectively i.e., (key "1" indicates the first wire of the connector, key "2" indicates the second wire of the connector, and so on).

As will be appreciated, a selected electric wire is detected as located in the termination position when its end impinges upon the front 15*a* of the stop block 15 in the wire guide station A. At this position and upon receipt of the proper signals, the punch 3 moves downward. The selected wire is pinched between the two insertion guide pieces 14*a*, 14*b*, and is subjected to termination with respect to a selected terminal. Thus, the correct wire-to-terminal relationship is assured, which permits effective terminations, regardless of the number of terminations.

In the instance where one set of wire ends has been previously connected to a first connector 36 (FIG. 6) and the remaining free ends of the harness wires are to be connected to a second connector, or other connectors, to form a wire harness, the wires are identified by the apparatus 100 rather than the operator. This identification is done electrically by the apparatus 100 rather than visually by the operator and virtually eliminates a mistaken termination of a wire to a terminal of the second or the other connectors. The wires are identified sequentially with the aid of the conductive test pin 21 and the wire-terminal identifying unit 30 in terms of the specific terminals of the first connector 36 to which the wires are connected.

The first connector 36 is connected to the matching connector 35 of the identifying assembly 30 to which the conductive test pin 21 is also connected to form an identifying circuit that extends between the test pin 21 and the free wire ends W of the wires connected to the first connector 36. When a second connector is to be terminated to the wires W, an operator merely inserts one of the harness wires W into the insertion-and-guide station B. When the test pin makes contact with the free end of the selected wire, a closed circuit is formed through the first connector 36, the matching connector 35 and the harness wires which identifies the position of that wire with respect to the specific terminal to which it is attached on the first connector 36. The support table 7 then brings the corresponding specific terminal of the second or other connectors in the connector holder 2 into position underneath the guide pieces 18*a*, 18*b* and punch 3. The control circuit 29, the wire-terminal identifying unit 30, the insertion detecting unit 31 and other associated means may be operatively connected and driven by a suitable control means, such as a microprocessor.

Figure 7:
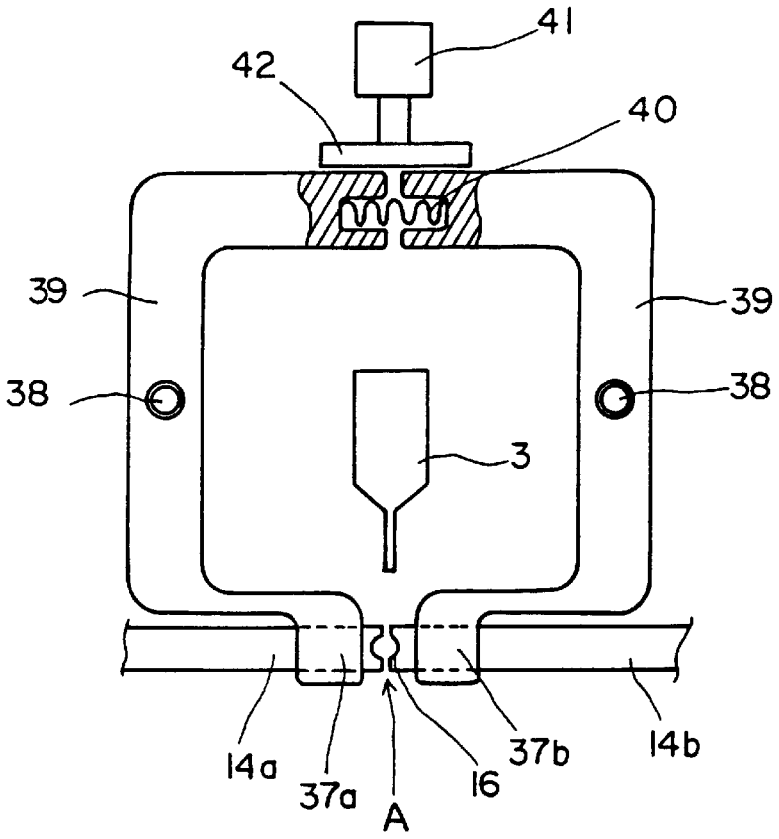
FIG. 7 is frontal view, partially in section, of another embodiment of the wire insertion-and-guide station of the wire termination apparatus of the present invention.
Figure 8:
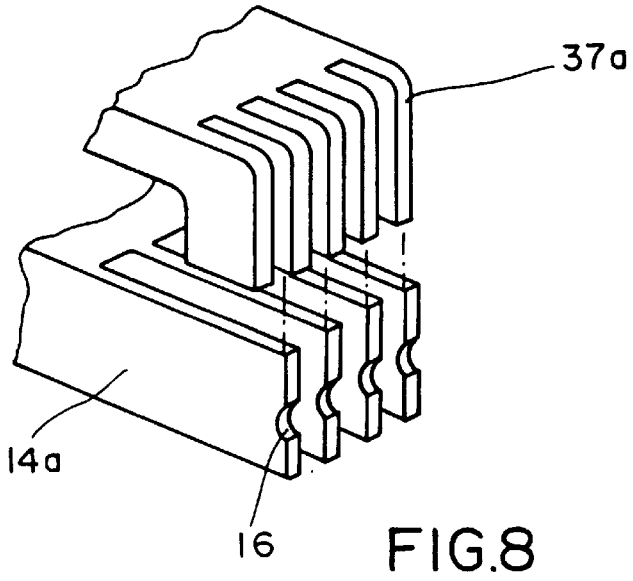
FIG. 8 is a perspective view of the wire clamps of the wire insertion-and-guide station of FIG. 7.

FIG. 7 shows another embodiment of the wire guide station A, that uses two opposing clamps 37*a*, 37*b* in addition to the two wire insertion guide pieces 14*a*, 14*b*. These clamps 37*a*, 37*b* are connected to a pair of support arms 39, that are pivotable around pivots 38. The support arms 39 are spring-biased in a manner that urges the clamps 37*a*, 37*b* toward each other. A vertically reciprocatable push plate 42 driven by an associated solenoid 41 is disposed above the spring-biased ends of the support arms 39. The solenoid 41 responds to a control signal from the control circuit 29 and selectively raises and lowers the push plate 42. Raising the push plate 42 (to the position shown in FIG. 7) causes the clamps 37*a*, 37*b* to approach each other, thus clamping a wire therebetween. On the other hand, downward movement of the push plate 42 causes the clamps 37*a*, 37*b* to move apart from each other. As seen from FIG. 8, the clamp 37*a* and associated insertion guide piece 14*a* may each have a comb-like shape.

The control circuit 29 responds to a signal from the detection means B that indicates the insertion of an wire into the insertion-and-guide station A and transmits a signal to the solenoid 41 to effect clamping of the wire. Advantageously, this clamping permits larger tolerances than the opposing guide pieces used alone regarding the relationship between the wire size and the space between the opposing guide pieces 14*a* and 14*b*.

Figure 9:
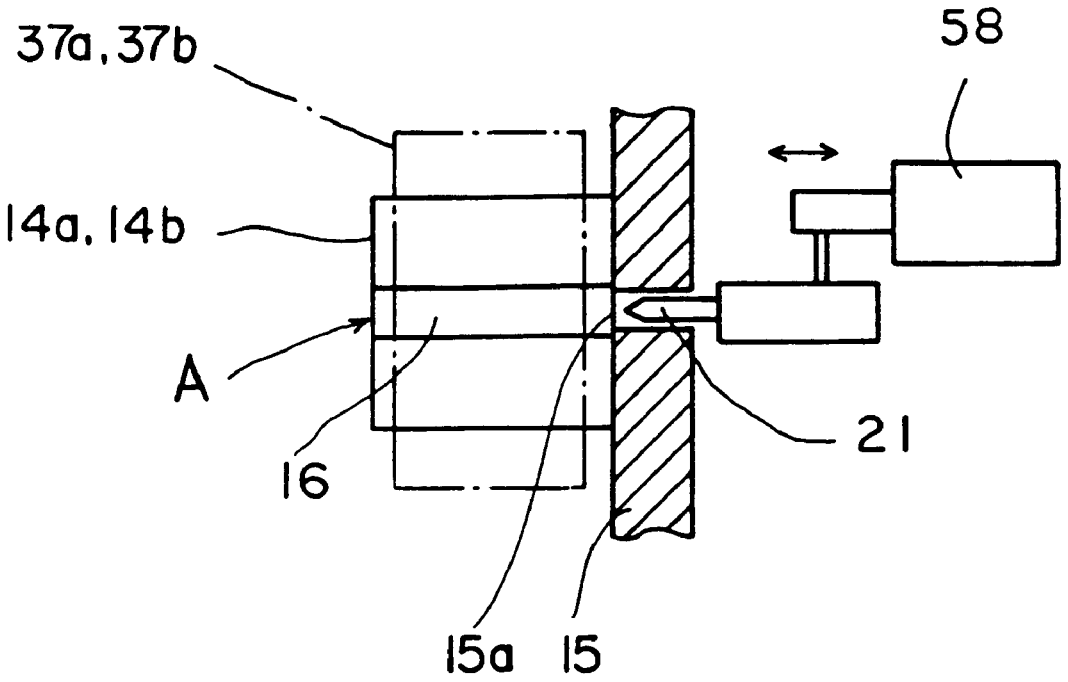
FIG. 9 is an elevational view of the conductive test pin and its drive mechanism.

Referring now to FIG. 9, the conductive test pin 21 is reciprocatable so that it may be brought towards and away from the ends of the wires that are held in place by the opposing guide pieces 14*a*, 14*b* and clamps 37*a*, 37*b*. As seen from FIG. 9, the reciprocation of the test pin 21 is effected by an associated solenoid 58, or other suitable operator. In the conduction-and-termination mode, for example, after the clamps 37*a*, 37*b* approach each other, the control circuit 29 transmits a drive signal to the solenoid 58, which drives the test pin 21 toward the wire until it contacts the end of the wire.

Figure 10:
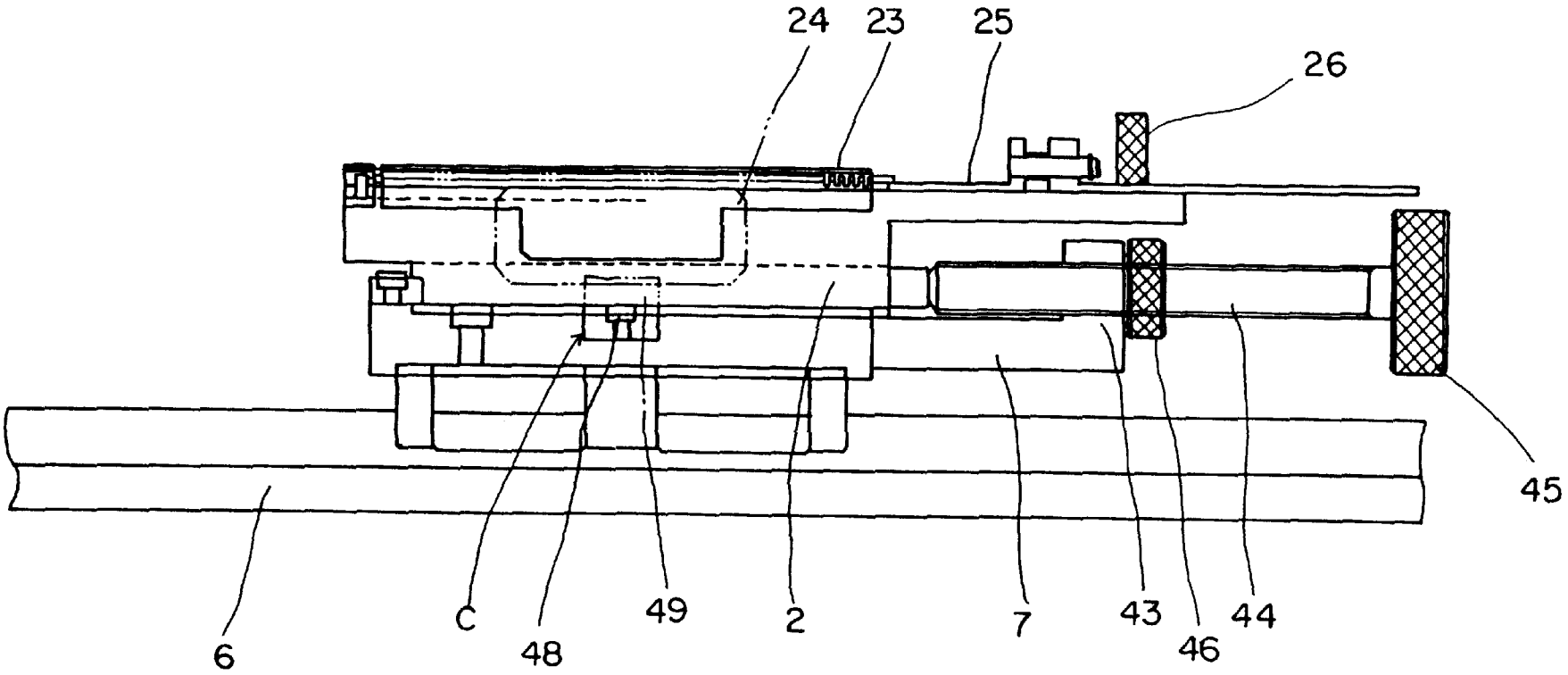
FIG. 10 is a frontal view of the connector holder of the termination apparatus of FIG. 1.

FIG. 10 illustrates how the connector holder 2 may be detachably mounted to the support table 7 (such details shown in this FIGURE being omitted in FIGS. 4 and 5 for clarity). The sliding support table 7 has a vertical end wall 43 that rises up at its right end, and the end wall 43 has a threaded rod 44 passing therethrough. This rod 44 may impinge upon the connector holder 2 in order to move it into a desired location and fixes it at this predetermined position. The threaded rod 44 has a knob 45 at its outer end, and a fixing nut 46 for preventing the loosening of the rod 44 in order to thereby retain the connector holder 2 at the desired position. The detachable mounting of the connector holder on the movable support table 7 facilitates the changing of the connector holder if desired. Specifically, a variety of connector holders each having a slot 22 of different size (see FIGS. 4 and 5) may be provided to contain connectors of different sizes. A selected connector holder 2 having connectors of a given size positioned in its slot 22 is mounted on the movable support table 7 for a specific operation.

There are two types of connectors that are particularly suited for use with the apparatus of the present invention. One such connector has its terminals arranged on one side of the connector while the other connector has its terminals arranged on both sides. Preferably, the support table 7 is equipped with means for determining what type of connectors are contained in the connector holder 2 mounted thereon. For this purpose, one of the aforementioned two kinds of connector holders for one-sided contact-type connectors or two-sided contact-type connectors has a physical mark to make the one kind of connector holder distinguishable from the other kind. The movable table 7 has a connector-style determination means C to make a required distinction in terms of the physical mark.

Specifically an access switch 48 is fixed to the upper, center part of the support table 7, whereas one of either the one-sided and two-sided contact type connector holders has a recess 49 (indicated in phantom in FIG. 10) made thereon at a position such that the recess 49 confronts the access switch 48 when the connector holder 2 is mounted on the support table 7. The other type of connector holder 2 is mounted on the movable support table 7. Thus, the connector-style determination means C transmits an identification signal to the control circuit 29, and identifies the type of connector mounted on the movable support table 7 in terms of the presence or absence of the recess, thereby permitting the correct termination operation, regardless of the types of connectors that are supplied.

Figure 11:
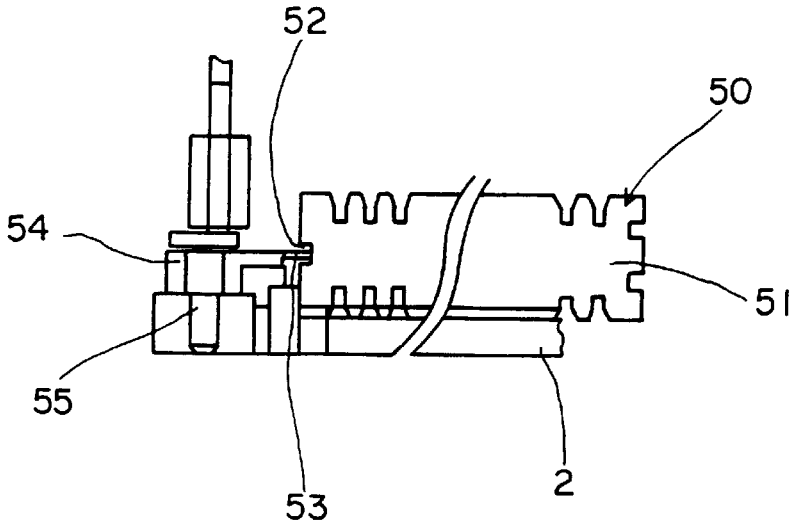
FIG. 11 is an end view of a means for determining the style of the connector with one connector illustrated being one and having terminals on both sides.
Figure 12:
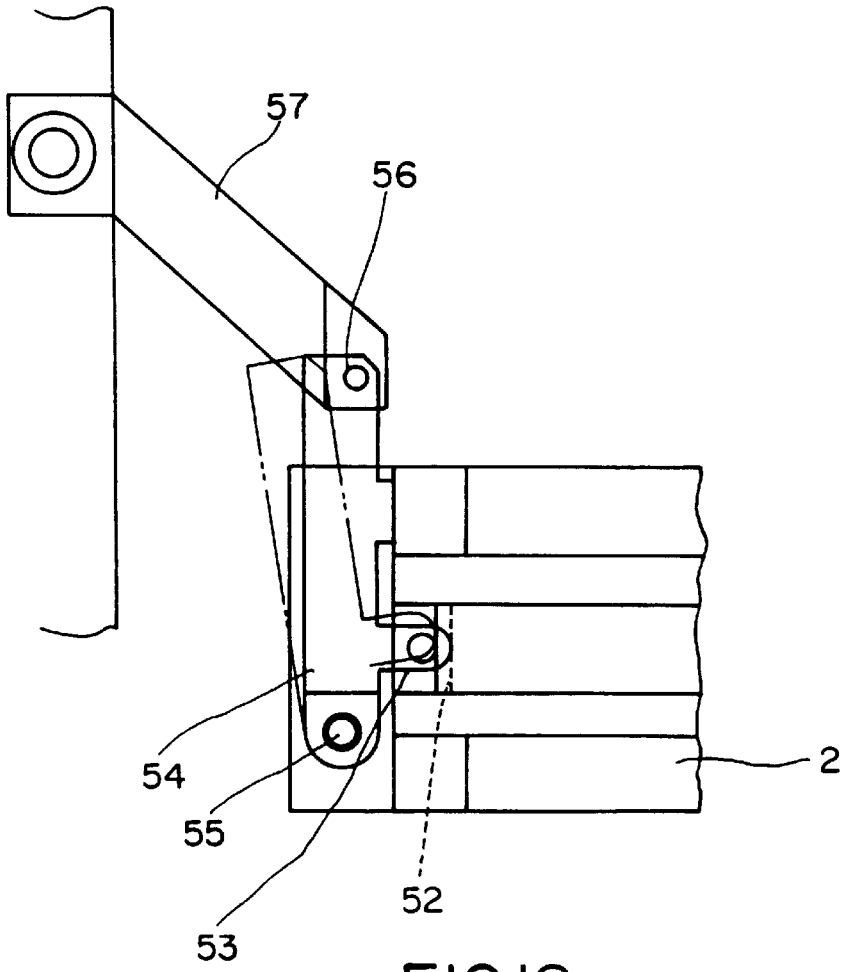
FIG. 12 is a plan view of the connector style determining means.

As for the termination of two-sided contact-type connectors, it is desirable, especially desirable in the conduction-and-termination mode, that a decision can be made as to which side of the connector faces the punch 3. For this particular purpose, connector-orientation decision means is provided as shown in FIGS. 11 and 12. A two-sided contact-type of connector 50 has a housing 51 having a recess 52 on one end. The connector holder 2 has a detection lever 54 rotatably fixed about an axle 55 on its left end that permits the projection 53 of the rotatable detection lever 54 to fit in the recess 52 of the particular connector 50. A sensor 56 in the form of an access switch is fixed to a support arm 57 so as to face the free end of the rotatable detection lever 54 (the support arm 57, also being shown in FIGS. 4 & 5). The sensor 56 is connected to the control circuit 29 and transmits a connector identification signal thereto to identify the type of connector based upon engagement or non-engagement of the connector recess 52 by the detection lever 54.

The control circuit 29 determines which side of the connector 50 is facing the punch 3, depending on whether it receives an appropriate signal from the sensor, thereby assuring the correct termination relative to the terminal arrangements in the connector. It will be appreciated that the present invention significantly automates the termination of wire harness assemblies with a reduction in the likelihood of wrong wire terminations.

It will be appreciated that the embodiments of the present invention which have been discussed are merely illustrative of some of the applications of this invention and that numerous modifications may be made by those skilled in the art without departing from the true spirit and scope of this invention.

We claim:

1. A wire termination apparatus for terminating connector terminals to wires for use in making wire harnesses, wherein each wire harness includes a plurality of wires, with opposite ends of the wires being connected to respective first and second connectors, each of said connectors having a plurality of terminals disposed in side-by-side order thereon, the apparatus comprising:

a holder for holding a first connector, said holder being mounted for movement along a predetermined connector workpath of said apparatus;

a drive mechanism for driving the connector holder in reciprocating movement along said workpath and an associated encoder for indicating to said drive mechanism locations of said terminals on the first connector held in said connector holder;

a punch for terminating a selected wire of said harness wires onto a selected terminal of said first connector, said punch being disposed above the connector workpath and driven in a reciprocating manner into and out of said connector workpath;

a wire guide mechanism for guiding said selected wire to a termination position, the wire guide mechanism including a detector for detecting the end of said selected wire in place at the termination position within said wire guide mechanism, said wire guide mechanism holding said selected wire stationary at said termination position while said drive mechanism drives said connector holder into place beneath said punch such that said selected wire is aligned with the selected terminal of said first connector; and, means operatively interconnecting said connector holder, punch, wire guide mechanism and detector together and for controlling the connector holder drive so as to permit terminals of said first connector and second connector held in said connector holder to selectively driven in specific order into alignment with said punch.

2. The wire termination apparatus according to claim 1, wherein said wire guide mechanism includes a pair of clamps that selectively engage a free end of said selected wire.

3. The wire termination apparatus according to claim 1, further including means for identifying a specific terminal of said first connector to which said selected wire is connected to, thereby permitting identification by said apparatus of a corresponding specific terminal of the second connector held by said connector holder.

4. The wire termination apparatus according to claim 3, wherein said specific terminal identification means includes a conductive test member that is selectively movable into and out of contact with said selected wire held by said wire guide mechanism.

5. The wire termination apparatus according to claim 4, said specific terminal identification means includes a mating conductor adapter to engage said first connector, said mating connector being electrically coupled to said conductive test member.

6. The wire termination apparatus according to claim 1, wherein said connector holder drive mechanism includes a movable support table that supports and detachably receives said connector holder.

7. The wire termination apparatus according to claim 6, wherein said support table includes means for determining a style of said connector holder mounted thereon.

8. The wire termination apparatus according to claim 6, wherein said connector holder includes means for determining a style of connector inserted therein.

9. The wire termination apparatus according to claim 1, wherein said detector includes an optical sensor.

10. The wire termination apparatus according to claim 1, further including a plurality of terminal identification keys for identifying a specific terminal on said first connector to be moved into said termination position, said keys being operatively connected to said connector holder drive mechanism and said associated encoder.

11. The wire termination apparatus according to claim 10, wherein each of said identification keys is associated with the specific terminal of said first connector.

* * * * *